US005695180A

United States Patent [19]

Künzle

[11] Patent Number: 5,695,180

[45] Date of Patent: Dec. 9, 1997

[54] DEVICE FOR CONVEYING A FRONT END OF A MATERIAL WEB IN A WEB-FED ROTARY PRESS

[75] Inventor: René Künzle, Bern, Switzerland

[73] Assignee: Maschinenfabrik Wifag, Bern, Switzerland

[21] Appl. No.: 642,628

[22] Filed: May 3, 1996

[30] Foreign Application Priority Data

May 5, 1995 [CH] Switzerland ..... 195 16 655.8

[51] Int. Cl.[6] ..... B41F 13/64

[52] U.S. Cl. ..... 270/18; 226/28

[58] Field of Search ..... 270/18; 226/24, 226/28, 102, 112

[56] References Cited

U.S. PATENT DOCUMENTS

| | | | |
|---|---|---|---|
| 852,429 | 5/1907 | Gauch | 270/18 |
| 3,556,509 | 1/1971 | Crum | 226/28 |
| 4,896,605 | 1/1990 | Schroder | 226/28 |
| 4,984,773 | 1/1991 | Balban et al. | 270/18 |
| 5,117,610 | 6/1992 | Hartmann et al. | 270/18 |

*Primary Examiner*—John T. Kwon

*Attorney, Agent, or Firm*—McGlew and Tuttle

[57] ABSTRACT

A device for conveying a front end of a material web, which is fed in a web-fed rotary press, especially a printing press. The device has a deflecting device for deflecting the web and a feed device for the deflected web, which is arranged at a distance from the deflecting device in the direction of feed of the deflected web. A guiding device, which guides a front end of the web around the deflecting device during the deflecting, is arranged adjacent to the deflecting device. Lying on a circulating conveyor belt, the deflected web front end is fed to the feed device.

17 Claims, 4 Drawing Sheets

DEVICE FOR CONVEYING A FRONT END OF A MATERIAL WEB IN A WEB-FED ROTARY PRESS

FIELD OF THE INVENTION

The present invention pertains to a device for conveying a front end of a material web, which is fed in a web-fed rotary press, particularly a printing press, with a deflecting device for deflecting the web and with a feed device for the deflected web, which is arranged at a distance from the deflecting device in the direction of feed of the deflected web. The present invention also pertains to a process for bringing together two material webs in a web-fed rotary press, in which a first web is deflected via a deflecting roller, is fed to a feed device and is subsequently brought together with a second web. The present invention is preferably used in a printing press.

BACKGROUND OF THE INVENTION

In the web-fed rotary printing, printed partial webs, after being folded lengthwise, which usually takes place by feeding the webs through hoppers, are to be brought together again before they are fed to a folder. The front ends of the individual partial webs are brought together via corresponding conveying devices into a single web strand, in which the lengthwise-folded printed webs lie above one another, approximately coincident. The partial webs are usually brought together or drawn in manually via the deflecting means provided in the conveying area for this purpose, especially deflecting rollers. In this case, an operator picks up a front end of such a lengthwise-folded partial web, e.g., by means of a hook, and delivers the picked-up front end to a second operator, who feeds or mounts the picked-up web front end in the area of a feed means, especially a web diverting roller, such that this web front end comes to lie coincident with another partial web fed endlessly in the area of the feed means, and is fed further together with this other partial web. The manual bringing together of partial webs is time-consuming, prone to trouble and requires the cooperation of at least two operators.

SUMMARY AND OBJECTS OF THE INVENTION

The object of the present invention is to make possible the conveying of a front end of a material web fed in a web-fed rotary press without an operator having to pick up and deliver such a web front end for further feeding.

According to the invention, a device is provided for conveying a front end of a material web fed in a web-fed rotary press, especially a printing press. A deflecting means is provided for deflecting the web and a feed means is provided for the deflected web, which is arranged at a distance from the deflecting means in the direction of feed of the deflected web. A guiding means, which guides a front end of the web around the deflecting means during the deflecting, is arranged adjacent to deflecting means, and the deflected web front end, lying on a circulating conveyor belt, is fed to the said feed means.

According to another aspect of the invention, a web-fed rotary printing press is provided, in which a first printed web is deflected about a first deflecting roller, the deflected printed web is fed to a second deflecting roller, is deflected again by this and is brought together with a second printed web. The device is employed to convey a front end of the first printed web to the second deflecting roller.

The guiding means is preferably formed by a guide plate or the like, on which a front end of the material web, sliding on the conveyor belt, is fed.

While a guiding means is arranged adjacent to a deflecting means for a material web, especially a printed web, according to the present invention, the front end of the web fed in can be deflected into a desired new direction of feed by means of the guiding means, which is guided in a restricted manner about the deflecting means. According to the present invention, the thus deflected front end of the web is picked up by a conveyor belt and fed to a feed means. Here, the front end of the deflected web simply rests on the conveyor belt. The conveyed web front end is fed further in a suitable manner from the area of the feed means.

The conveyor belt is preferably jointly driven by placing it against a web feeding means, preferably the deflecting means. It is driven by its own motor in a likewise preferred embodiment.

In the preferred use of the device according to the present invention, namely to bring together two lengthwise-folded printed webs in a web-fed rotary printing press, the deflecting means is a deflecting roller, especially a table roller, and the feed means is a web diverting roller, which is arranged at a distance thereto. Shortly behind this web diverting roller, namely the feed means, the printed web conveyed according to the present invention runs under another previously lengthwise-folded printed web, namely the web, with which it is to be brought together for subsequent cutting and folding. A web-fed rotary printing press may have a plurality of conveying devices designed according to the present invention, which are usually arranged next to one another diagonally to the direction of feed of the web.

According to the present invention, the deflecting means and the guiding means form a type of feeding hopper for the front end of the material web to be conveyed. Particularly in the preferred use of web-fed rotary printing presses, the front end of the web in question is fed from the folding hopper essentially vertically downwards to a deflecting roller and is fed into another deflecting roller arranged laterally next to this deflecting roller by about 90° from its direction of feed. Because of this web feeding supported by gravity, a feeding hopper, which is open at the top, is completely sufficient to reliably divert the freely suspended front end of the web.

In an especially preferred embodiment of the present invention, the conveyor belt also forms the diverting means at the same time. To divert a web front end, this conveyor belt partially winds around the deflecting means. The conveyor belt is advantageously guided around at least three belt diverting rollers, which are arranged with one another in the shape of a triangle. For partially winding around the deflecting means, the conveyor belt is preferably pressed or placed against the deflecting means in the area of a run, especially a carrying run.

The conveyor belt is preferably arranged pivotably for placing against the deflecting means. While the conveyor belt can be placed against the deflecting means with a partial winding around the deflecting means, it can correspondingly again be removed from the deflecting means after conveying the web front end and after further feeding the conveyed material web, so that the conveyed material web is only able to be fed further, guided via the otherwise usual deflecting means. By means of the removal after the conveying has been carried out, the printing ink, which has possibly run onto the conveyor belt, is prevented in a very simple manner from being able to be transferred to the material web, if it is a printed web.

One of the three belt diverting rollers may be formed by the feed means itself. This also represents a preferred embodiment of the present invention. According to another preferred embodiment, the conveyor belt is mechanically independent of the other deflecting means of the web-fed rotary printing press. According to the embodiment, either the feed means designed as a deflecting roller or a separate belt diverting roller arranged in direct proximity to the feed means forms the drive of the circulating conveyor belt.

In the latter case, an additional web feed means is arranged between this belt diverting roller and the feed means to support the front end of the web in its feeding into or winding onto the feed means. In a web-fed rotary printing press, in which the feed means is usually designed as a web diverting roller, this diverting roller is advantageously provided with circumferential grooves for this purpose, and the web feed means engages in these grooves like a rake, so that it is possible to guarantee a seamless feeding of the web front end.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
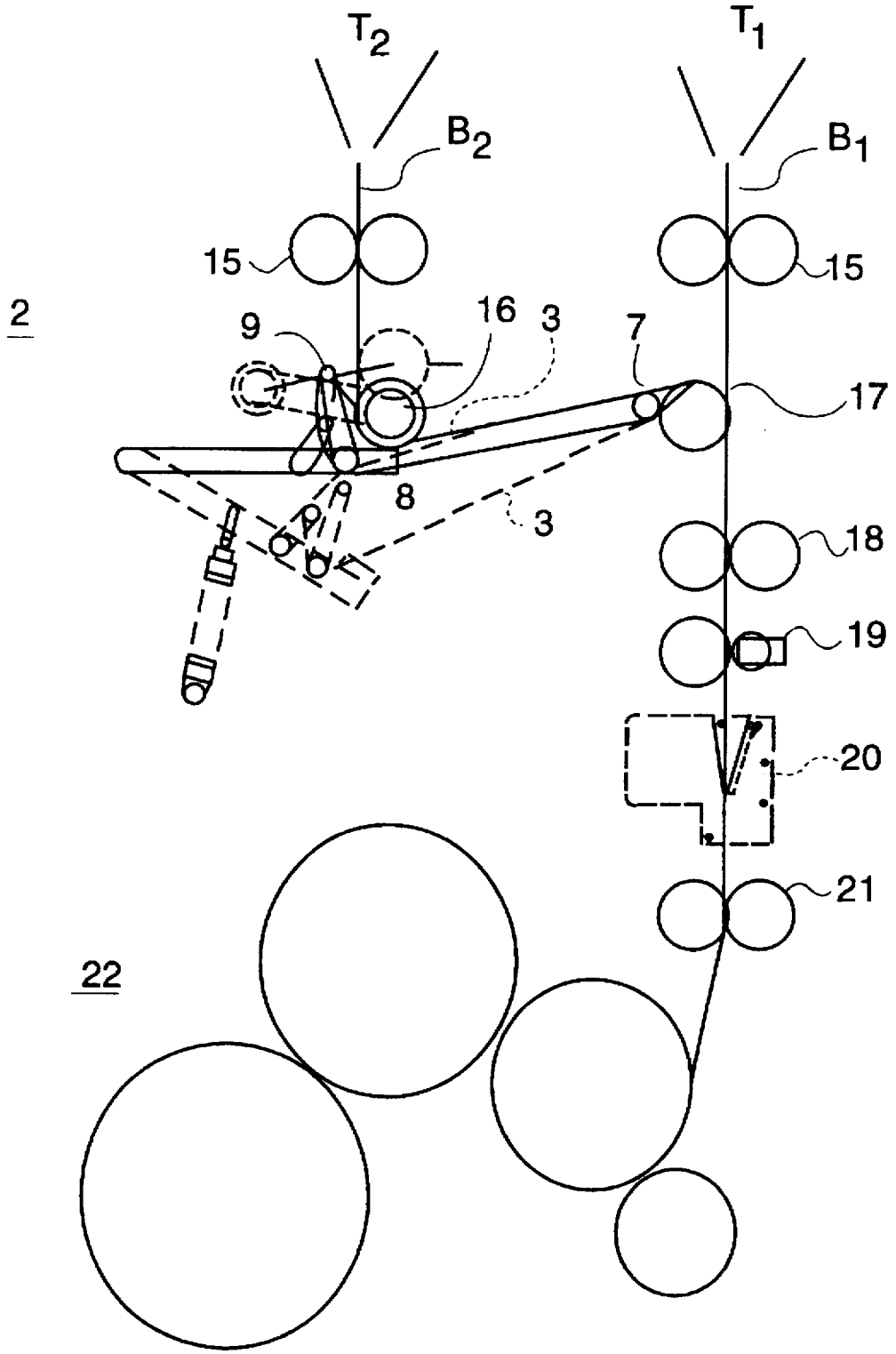
FIG. 1 is a partially schematic view showing a bringing together of two lengthwise-folded printed partial webs according to the present invention.

FIG. 1 shows the bringing together of two printed partial webs $B_1$ and $B_2$, which have each been folded lengthwise in hoppers $T_1$ and $T_2$. The two lengthwise-folded printed partial webs $B_1$ and $B_2$ are each fed via draw roller pairs 15, and the front end of each of these two partial webs $B_1$ and $B_2$ is first fed, freely suspended, approximately vertically downwards by the respective draw roller pair 15. Under one of the two draw rollers pairs 15 is arranged a feed means, in the exemplary embodiment a web diverting roller 17, past which the free front end of the corresponding first printed partial web $B_1$ passes at a slight distance, it arrives at another draw roller pair 18 in its further feeding by the draw roller pair 15, is fed between the two rollers of this draw roller pair 18 and is fed further by these.

To be brought together with the first printed partial web $B_1$, the front end of the other second printed partial web $B_2$ must first be deflected about a deflecting means 16, also a web diverting roller in the exemplary embodiment, especially a table roller, which is arranged approximately vertically under the draw roller pair 15 being used for feeding the second printed partial web $B_2$, and must be fed to the feed means 17 to be deflected by the feed means 17 in the same direction as the first printed partial web $B_1$, which is essentially simply fed in a straight line.

For conveying the front end of the second partial web $B_2$, this front end is guided by means of a conveying device 2 about the deflecting means 16, and lying on the conveyor belt 3, is fed further to the feed means 17. The front end of the second partial web $B_2$ is deflected via the feed means 17 in the direction of feed of the first partial web $B_1$, and when it is fed further, it arrives freely suspended between the rollers of the draw roller pair 18, which is arranged downstream of the feed means 17. By means of the draw roller pair 18, the two partial webs $B_1$ and $B_2$ lying upon one another are fed via a retaining device 19, a cutting device 20 and another draw roller pair 21 to a folder 22 in the known manner.

Figure 2:
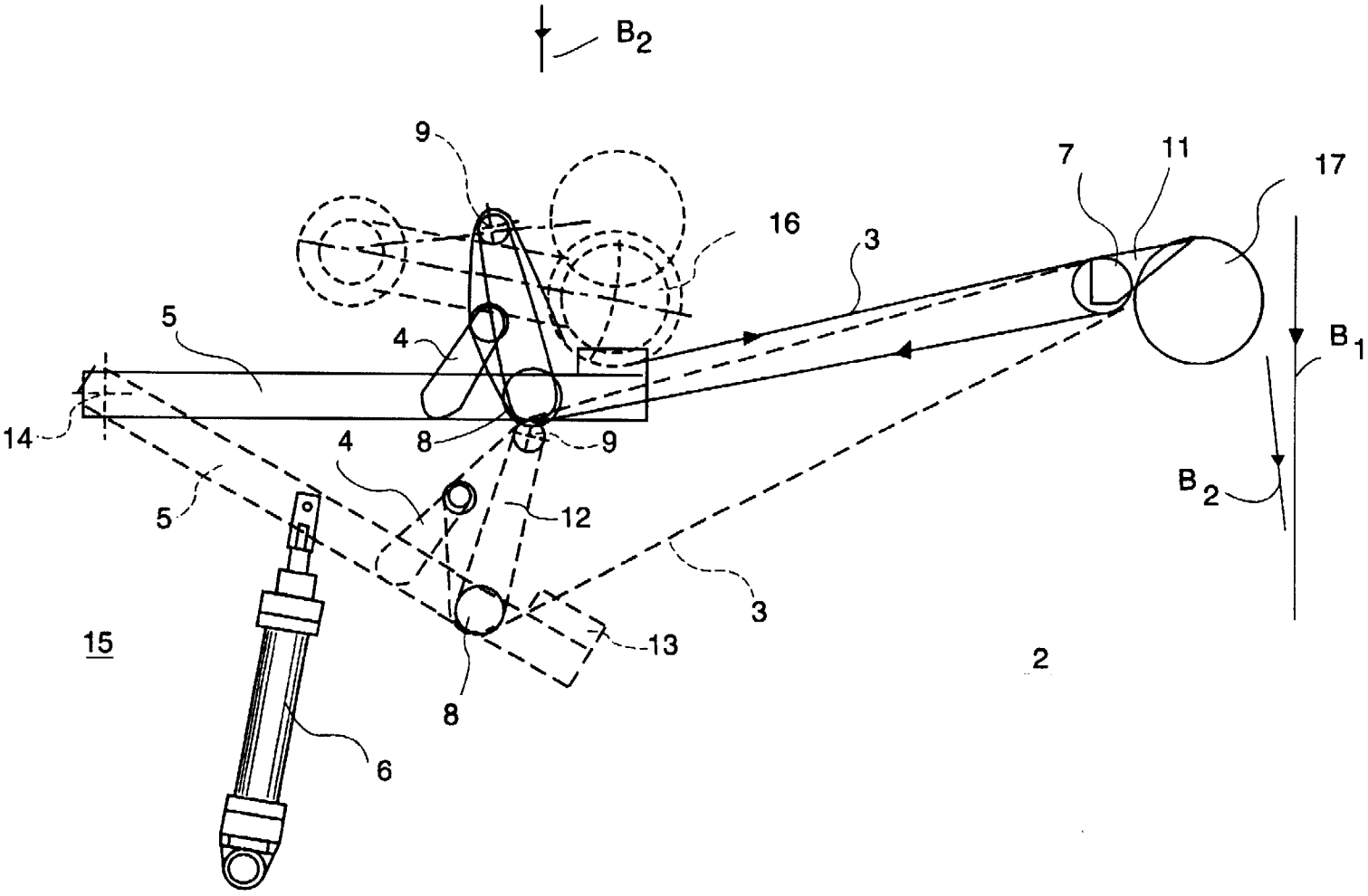
FIG. 2 is a detailed partially schematic view of the conveying device according to FIG. 1.

FIG. 2 shows the web conveying device 2 according to FIG. 1 by itself. The front end of the second partial web $B_2$ to be conveyed, which front end is fed vertically downwards, is shown before the feeding into the conveyor device 2. In the case of a web-fed rotary printing press, the deflecting means 16 is formed by a table roller, which is shown in FIG. 2 in its two final positions. The conveyor belt 3 revolves around three belt diverting rollers 7, 8 and 9, as well as via a tension roller, which is supported on an adjustable arm 4. The first belt diverting roller 7 is arranged in direct proximity to the feed means 17, which is formed by a web diverting roller in the exemplary embodiment. The three belt diverting rollers 7, 8 and 9 form a triangular arrangement. In the area of a carrying run of the conveyor belt 3 between the rollers 7 and 8, the conveyor belt 3 is placed against the table roller 16, so that it likewise winds around this table roller 16 from below essentially in the area, in which the conveyed first partial web $B_1$ winds around the table roller 16. The table roller 16 and the carrying run of the conveyor belt 3 lying in the deflecting area form a type of feeding hopper for the front end of the partial web $B_2$ fed from above. The fed-in front end first runs on the carrying run of the conveyor belt 3. It is then drawn in between the table roller 16 and this carrying run, and clamped between these two, it is fed about the table roller 16. After the deflecting, the web front end rests freely on the carrying run in its section between the table roller 16 and the first belt diverting roller 7. By means of feeding through between the table roller 16 and the conveyor belt 3, the web front end, lying on the conveyor belt 3, arrives at the first belt diverting roller 7.

A rake-like web support means 11, via which the web front end is almost continuously fed to the web diverting roller 17 arranged downstream, is arranged between the conveyor belt 3, which runs around the first belt diverting roller 7, and the web diverting roller 17, arranged downstream of this belt diverting roller 7. With its rake-like fingers, the web support means 11 engages in the corresponding circumferential grooves of the web diverting roller 17. In the exemplary embodiment, the web support means is mounted in a rotating manner on the axis of rotation of the belt diverting roller 7.

The conveyor belt 3 can be placed against the table roller 16 or removed from it by means of retraction. The placing against and removal from take place by pivoting about the axis of rotation of the driven belt diverting roller 7. FIG. 2 shows the conveyor belt 3 in a position placed against the table roller 16 in the solid line and in its position removed therefrom in the broken line. By the placing against the table roller 16, the conveyor belt is jointly driven by the table roller 16. The belt diverting roller 7 is driven by its own motor in another, likewise preferred embodiment.

The second belt diverting roller 8 and the third belt diverting roller 9 are attached to an adjusting device 15, which is pivotably arranged about an axis 14, for the purpose of placing and removing the conveyor belt 3 against or from the table roller 16. In the exemplary embodiment, the adjusting device 15 is formed by a simple bar 5, which has a stop 13 for limiting the pivoting movement of the adjusting device 15 against the table roller 16. The second belt diverting roller 8 is rotatably mounted directly on the bar 5, while the third belt diverting roller 9 is rotatably mounted on a support arm 12, which is at an angular distance from this bar 5. The arm 4, which supports the tension roller for the conveyor belt 3, is pivotably mounted on the bar 5 for adjusting the desired belt tension. The pivoting movement of the bar 5 of the adjusting device 15 about the axis of rotation 14 and thus also the pivoting movement of the conveyor belt 3 about the first belt diverting roller 7 is brought about by an adjusting cylinder 6, which is joined to the bar 5.

Viewed in the longitudinal direction of the table roller 16, the conveyor belt 3 is formed by a plurality of belt strips, which run parallel next to each other. The belt diverting rollers 7, 8, 9 and the adjusting device 15 are designed correspondingly.

In the removed position, the conveyor belt 3 is guided approximately in the shape of a triangle about the three belt diverting rollers 7, 8 and 9. When it is placed against the table roller 16, the belt 3 is pressed in between the first belt diverting roller 7 and the third belt diverting roller 9 in the area of the carrying run and thus partially winds around the table roller 16. The conveyor belt 3, when placed against the table roller 16, assumes approximately the shape of an "L" on its side. The short side of this "L" pointing upwards, together with the table roller 16, forms the feeding in for the partial web $B_2$ and the winding around to the table roller 16, and the long side of this "L", which lies approximately horizontally or slight sloped to the horizontal, points in a straight line to the web diverting roller 17, which is used as the feed means.

While the conveyor belt 3 can be removed from the table roller 16 and thus disengaged from it, which takes place at the moment, at which the front end of the conveyed second partial web $B_2$ has been picked up by the rollers of the draw roller pair 18, which are arranged downstream of the web diverting roller 17, the printing ink residues, which have possibly been transferred to the conveyor belt 3, can be prevented from being transferred again from the conveyor belt 3 to the already conveyed partial web $B_2$. After the conveying of the partial web $B_2$ or after the bringing together with the partial web $B_1$, the conveyed partial web $B_2$ runs, without touching the removed conveyor belt 3, about the table roller 16 and the web diverting roller 17 arranged downstream. After the conveyor belt 3 has been removed or disengaged from the table roller 16, the drive of the first belt diverting roller 7 can be switched off. In this position, the idling or switched-off conveyor belt 3 can, e.g., be serviced, especially cleaned.

Figure 3:
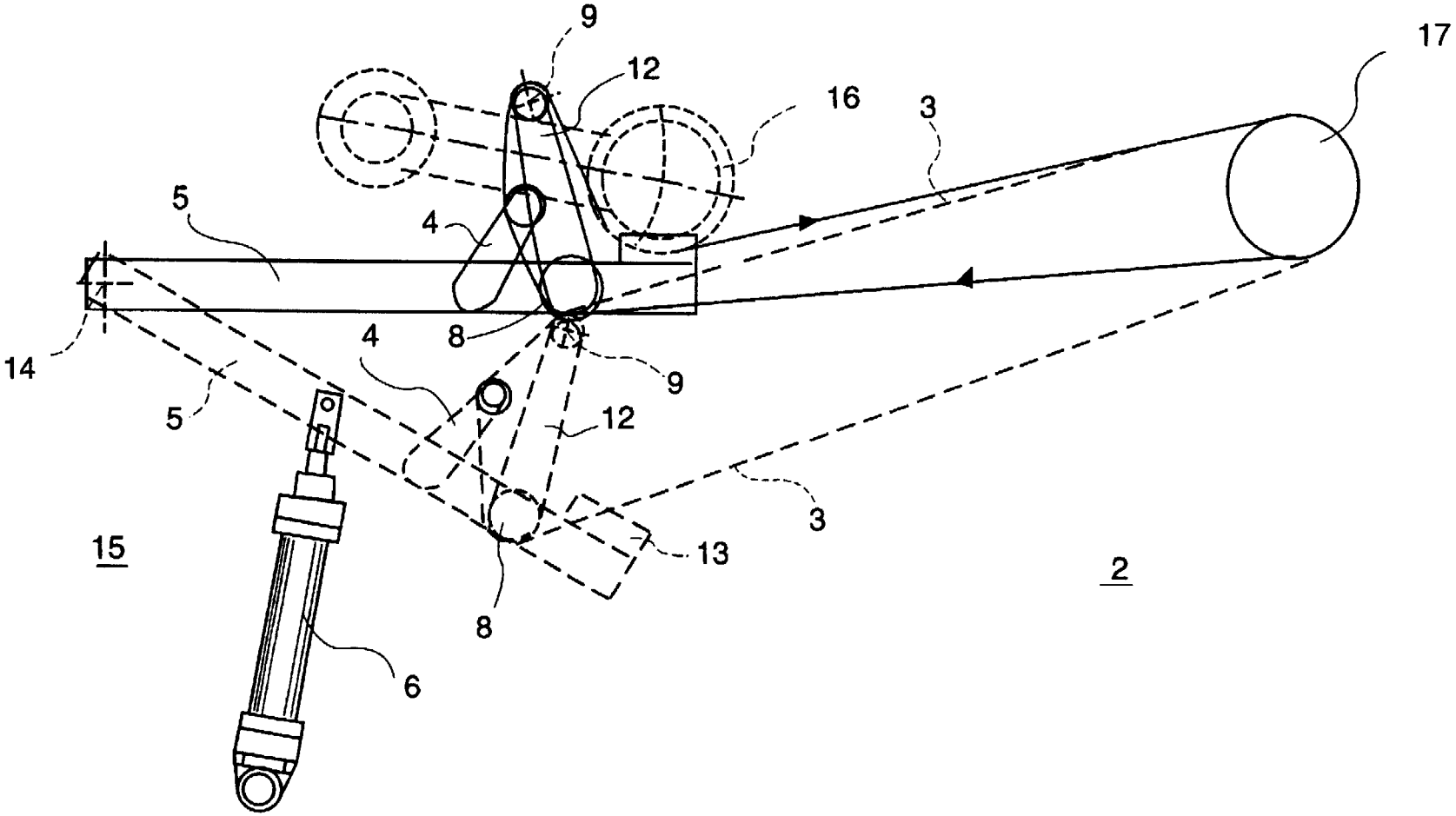
FIG. 3 is a partially schematic view of a first embodiment alternative of a conveying device according to the present invention.

FIG. 3 shows a first embodiment alternative for a conveying device according to the present invention. The conveying device according to FIG. 3 differs from that according to FIG. 2 only in that no separate drive roller, namely the belt diverting roller 7, is provided. In the exemplary embodiment according to FIG. 3, the conveyor belt 3 revolves around the web diverting roller 17, which thus assumes the function of a driven belt diverting roller at the same time. The conveyor belt 3 can correspondingly be placed against and removed from the table roller 16 about the axis of rotation of the web diverting roller 17. Otherwise, the design and the mode of operation of this embodiment alternative are the same as those according to FIG. 2.

Figure 4:
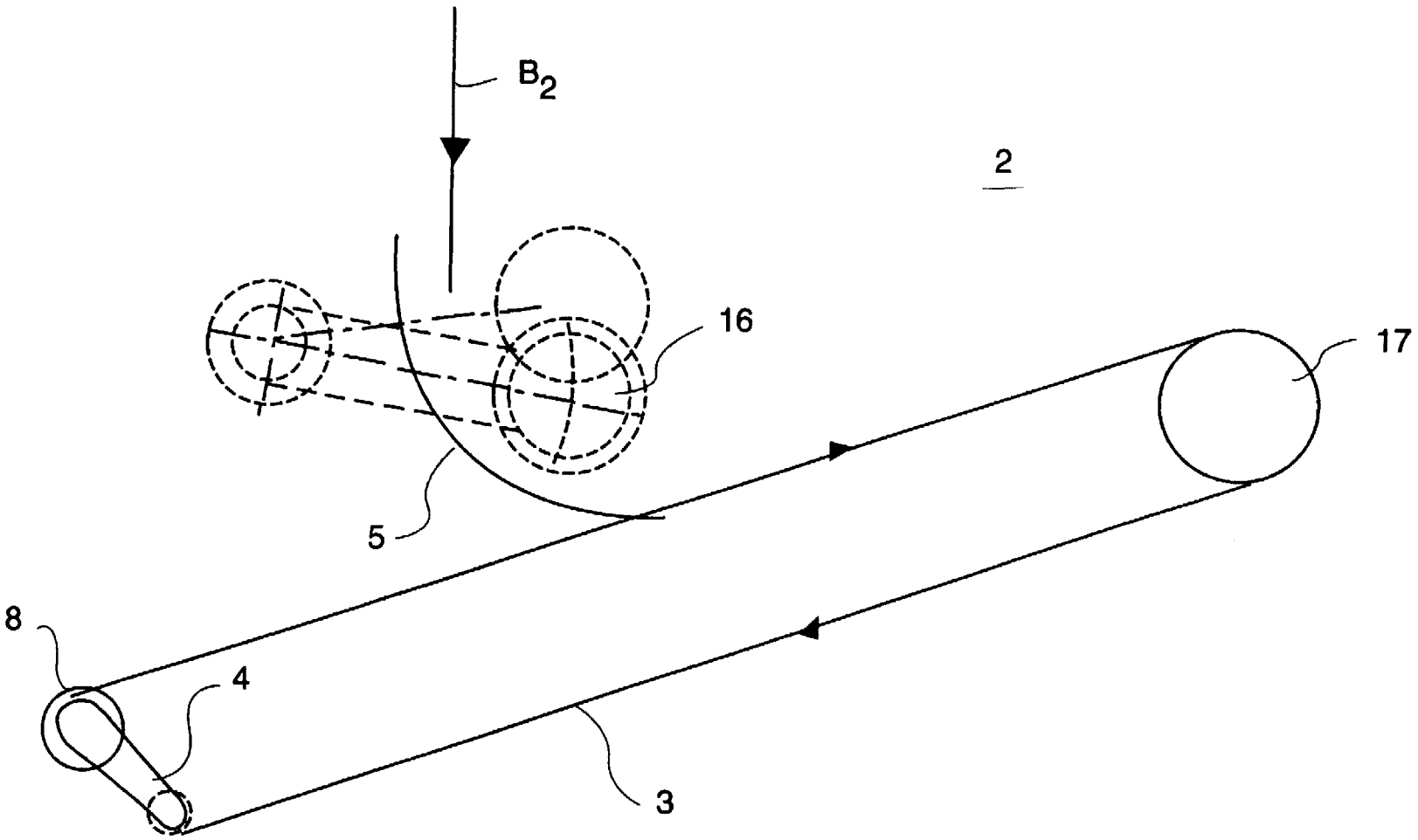
FIG. 4 is a partially schematic view of a second embodiment alternative according to the invention.

FIG. 4 shows a mechanically especially simple conveying device 2. Here, a rigid guiding means 5, a simple guide plate in the exemplary embodiment, is arranged adjacent to the table roller 16. The guiding means 5, together with the table roller 16, again forms a hopper-like feeding in for the fed-in front end of the second partial web $B_2$. The fed-in web front end first impacts on a rounded deflecting surface of the guiding means 5, facing the table roller 16, and slides on this deflecting surface with its further feeding on the conveyor belt 3.

An upper end of the guiding means 5 points slopingly towards the web front end being fed in. In the further course, the deflecting surface of the guiding means runs approximately concentrically to the surface of the table roller 16. A lower end of the guiding means 5 projects like a rake between the belt strips of the conveyor belt 3, so that the web front end is continuously supported from below.

The web front end is conveyed on the conveyor belt to the web diverting roller 17 arranged downstream, as in the exemplary embodiment according to FIG. 3.

The conveyor belt according to FIG. 4 is not pivotable. It only runs about the two rigidly mounted belt diverting rollers 17 and 8, and about the tension roller 4. This embodiment variant is characterized by its simplicity and its comparably favorable initial costs.

While specific embodiments of the invention have been shown and described in detail to illustrate the application of the principles of the invention, it will be understood that the invention may be embodied otherwise without departing from such principles.

What is claimed is:

1. A device for conveying a front end of a material web-fed in a web-fed rotary press, the device comprising:

deflecting means for deflecting the web from a first direction of travel to another direction of travel;

feed means for feeding the deflected web, said feed means being arranged at a distance from said deflecting means in a direction of feed of said deflected web;

guiding means for guiding a front end of the web around said deflecting means during deflection of the front end of the web, said guiding means being arranged adjacent to said deflecting means; and conveying means including a circulating conveyor belt for conveying a deflected and guided web front end from said deflecting means to said feed means.

2. A device in accordance with claim 1, wherein said guiding means and said deflecting means provide a hopper-like feeding of the front end of the web.

3. A device in accordance with claim 1, wherein said web fed rotary press is a printing press and said circulating conveyor belt is pivotable between a location placed against said deflecting means and a location retracted from said deflecting means.

4. A device in accordance with claim 1, wherein said web fed rotary press is a printing press and said circulating conveyor belt winds around said deflecting means in a web deflecting area to form said guiding means.

5. A device in accordance with claim 1, wherein said web fed rotary press is a printing press and said circulating conveyor belt is guided around at least three belt diverting rollers and a run of said conveyor belt presses against said deflecting means, winding around said deflecting means in a web deflecting area to form said guiding means.

6. A device in accordance with claim 5, further comprising an adjusting device including a second belt diverting roller a third belt diverting roller, which are arranged with said first belt diverting roller in the form of a triangle, are movable, especially for positioning said conveyor belt at a location against and away from said deflecting means.

7. A device in accordance with claim 5, wherein said second belt diverting roller said third belt diverting roller are pivotably movable.

8. A device in accordance with claim 1, wherein said web fed rotary press is a printing press and said circulating conveyor belt is guided around belt diverting rollers including a first belt diverting roller arranged in the direction of feed of the web directly in front of said feed means.

9. A device in accordance with claim 8, further comprising web support means, for supporting the web front end lying thereon for delivery to said feed means, said web support means being arranged between said conveyor belt and said feed means.

10. A device in accordance with claim 1, wherein said web fed rotary press is a printing press and said circulating conveyor belt is guided around belt diverting rollers including a first belt diverting roller for said conveyor belt formed by the said feed means.

11. A device in accordance with claim 10, wherein said a first belt diverting roller is a drive roller.

12. A device in accordance with claim 1, wherein said guiding means is formed by a guide plate, on which a front end of the material web, sliding on the conveyor belt, is fed.

13. A device in accordance with claim 1, further comprising means for folding lengthwise said web upstream of said first deflecting roller and folding lengthwise said second web prior to forming said single web strand.

14. A web-fed rotary printing press, comprising:

first deflecting roller means for deflecting a first printed web;

second deflecting roller means for again deflecting the first printed web and bringing the first printed web together with a second printed web to form a single web strand;

guiding means for guiding a front end of the web around said deflecting means during deflection of the front end of the web, said guiding means being arranged adjacent to said deflecting means; and conveying means for conveying a front end of the first printed web to one of said feed means and said second deflecting roller, said web fed rotary press is a printing press and said conveying means comprises a circulating conveyor belt with said second deflecting roller means supporting said belt and forming a fed means for feeding the first printed web.

15. A device in accordance with claim 14, further comprising means for folding lengthwise said web upstream of said deflecting means and a second web folding means for folding lengthwise said second web.

16. A process for bringing together two material webs in a web-fed rotary printing press, comprising the steps of:

deflecting a first web is via a first deflecting roller at a deflecting area;

feeding the first web via a feed means;

feeding a second web;

guiding a front end of the first web by a guiding means in said deflecting area on the said deflecting means;

conveying a deflected front end of the web, lying on a conveyor belt, from a guided region of said deflector means to said feed means for said step of feeding; and bringing the first web together with said second web subsequent to said step of feeding to form a single web strand; and pulling said web strand into a printing press.

17. A process in accordance with claim 16, further comprising folding lengthwise said first web upstream of said deflecting means and a second web folding means for folding lengthwise a second web, said feeding means feeding said web together with said second web to form a single web strand.

* * * * *